US007392857B1

(12) United States Patent
Hall et al.

(10) Patent No.: US 7,392,857 B1
(45) Date of Patent: Jul. 1, 2008

(54) APPARATUS AND METHOD FOR VIBRATING A DRILL BIT

(76) Inventors: David R. Hall, 2185 S. Larsen Pkwy., Provo, UT (US) 84606; Scott Dahlgren, 2185 S. Larsen Pkwy., Provo, UT (US) 84606

( * ) Notice: Subject to any disclaimer, the term of this patent is extended or adjusted under 35 U.S.C. 154(b) by 72 days.

(21) Appl. No.: 11/619,418

(22) Filed: Jan. 3, 2007

(51) Int. Cl.
*E21B 7/00* (2006.01)
*E21B 10/36* (2006.01)
*B23B 51/00* (2006.01)

(52) U.S. Cl. ..... 175/57; 175/38; 175/297; 175/417; 175/426; 408/229

(58) Field of Classification Search ..... 175/122, 175/121, 135, 161, 162, 173, 195, 203, 38, 175/39, 24, 26, 40, 57, 385, 382, 426, 339, 175/297, 393, 415, 417, 425, 296; 408/229; 166/55.6
See application file for complete search history.

(56) References Cited

U.S. PATENT DOCUMENTS 465,103 A 12/1891 Wegner
616,118 A 12/1898 Kunhe
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midget
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,868,511 A * 1/1959 Barrett ..... 175/92

(Continued)

*Primary Examiner*—D. Lawrence Tarazano
*Assistant Examiner*—Yong-Suk Ro
(74) *Attorney, Agent, or Firm*—Tyson J. Wilde

(57) ABSTRACT

In one aspect of the invention a drill bit comprises an axis of rotation a body and a working face. The body comprises a fluid passageway with a first seat and houses a jack element substantially coaxial with the axis. A stop element is disposed within the passageway and has a first near-sealing surface. The jack element has a shaft intermediate an indenting end and a valve portion. The valve portion has a second near-sealing surface disposed adjacent the first near-sealing surface and a second seat disposed adjacent the first seat. As a formation strongly resists the jack element, the distance between the sealing surfaces narrows. This causes an increase in fluid pressure within the passageway and forces the indenting end down into the formation. This movement of the jack element relieves the pressure build up such that the formation pushes the jack element back, thereby oscillating the jack element.

20 Claims, 9 Drawing Sheets

U.S. PATENT DOCUMENTS 2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
9,629,076 4/2005 Fanuel
6,953,096 B2 10/2005 Gledhill
7,198,119 B1 * 4/2007 Hall ..... 175/57
7,225,886 B1 * 6/2007 Hall ..... 175/57
7,258,179 B2 * 8/2007 Hall ..... 175/404
7,270,196 B2 * 9/2007 Hall ..... 175/57
7,337,858 B2 * 3/2008 Hall ..... 175/40
2003/0213621 A1 11/2003 Britten
2004/0238221 A1 12/2004 Runia
2004/0256155 A1 12/2004 Kriesels

* cited by examiner

APPARATUS AND METHOD FOR VIBRATING A DRILL BIT

BACKGROUND OF THE INVENTION

This invention relates to the field of percussive tools used in drilling. More particularly, the invention relates to the field of downhole hammers which are actuated by the pressure of the drilling fluid. Some of these tools are generally known in the petroleum drilling industry simply as "downhole mud hammers".

Typically, downhole hammers are used to affect periodic mechanical impacts upon a drill bit. Through this percussion, the drill string is able to more effectively apply drilling power to the formation, thus aiding penetration into the formation.

The prior art has addressed the operation of a downhole hammer actuated by drilling mud. Such issues have been addressed in the U.S. Pat. No. 5,396,965 to Hall, which is herein incorporated by reference for all that it contains. The '965 patent discloses improvements in downhole mud actuated hammers. According to its broadest aspect the invention is a downhole mud actuated hammer for use in a drill string, which includes a housing with an upper end having means for connecting to the drill string. A throat is located within the housing which throat includes a main flow passage to allow high pressure drilling mud to pass therethrough. A piston is provided which is adapted to move axially within the housing means to thereby reciprocate between an up position and a down position. The piston is moved between the up and down position by a minor portion of the high pressure mud which portion passes from the main flow passage into at least one piston actuating chamber. This minor portion of mud is exhausted from the piston actuating chamber to a low pressure region out of the housing without being returned to the main flow passage.

U.S. Pat. No. 6,367,565 to Hall, which is also herein incorporated by reference for all that it contains, discloses a method of creating an electric signal that describes the motion of a downhole, fluid-driven percussive tool. The signal is obtained by attaching an electromagnetic transducer to the percussive tool, the member impacted by it, or the drill string. The rebound characteristics of the tool yield a measurement of the physical characteristics of the subterranean formation being penetrated. The tool's position over time is useful for diagnosing and regulating the operation of the tool. The transducer can also be configured to generate a signal large enough to be used as a power source.

BRIEF SUMMARY OF THE INVENTION

In one aspect of the present invention a drill bit comprises an axis of rotation and a drill bit body intermediate a threaded end and a working face. The drill bit body comprises a fluid passageway that has a first seat and houses a jack element substantially coaxial with the axis of rotation. A stop element is disposed within the passageway and has a first near-sealing surface. The jack element has a shaft intermediate an indenting end and a valve portion. The indenting end extends through the working face. The valve portion has a second near-sealing surface disposed adjacent the first near-sealing surface and a second seat disposed adjacent the first seat. As the formation being drilled strongly resists the jack element, the distance between the respective sealing surfaces narrows. This causes an increase in fluid pressure within the passageway and forces the indenting end down into the formation.

This movement of the jack relieves the pressure build such that the formation pushes the jack element back, thereby oscillating the jack element.

In some embodiments, a nozzle may be disposed within an opening in the working face to control and direct the drilling fluid as well as control the flow of debris from the subterranean formation. The second near-sealing surface of the jack element may have a rounded geometry. It may also have a hard surface of at least 58 HRc. Materials suitable for the near-sealing surfaces may be selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TIAlN, CrN/CrC/(Mo, W)S2, TiN/TiCN, AlTiN/MoS2, TiAlN, ZrN, diamond impregnated carbide, diamond impregnated matrix, silicon bounded diamond, and combinations thereof. The indenting end of the jack element may be comprised of a superhard material. It may also have an asymmetric geometry used to guide the drill bit during a drilling operation.

In some embodiments, a drill bit is attached to a downhole tool string component for use in oil, gas, and/or geothermal drilling; however, the present invention may be used in drilling applications involved with mining coal, diamonds, copper, iron, zinc, gold, lead, rock salt, and other natural resources, as well as for drilling through metals, woods, plastics and related materials. The downhole tool string may have a sensor that is adapted to receive acoustic reflections produced by the movement of the jack element. The sensor is used to determine the location of reflectors in subterranean formations. Examples of reflectors include boundaries between different sedimentary formations; faults, cracks, or cavities; zones permeated with different fluids or gases; and zones exhibiting a gradient in pore pressure.

In another aspect of the invention a method has steps for drilling a well bore with a drill bit having an axis of rotation and drill bit body intermediate a threaded end and a working face. The drill bit body may have a fluid passageway comprising a first seat and housing a jack element. The drill bit may also have a stop element disposed within the passageway comprising a first near-sealing surface. The jack element has a valve portion and an indenting end that extends through the working face. The valve portion may have a second near-sealing surface adjacent to the first near-sealing surface.

When a first axial force is applied by pressurizing the fluid passageway and an opposing force is also applied to the jack element, the near-sealing surfaces may form a restriction in the fluid passage from the fluid passageway to at least one opening disposed in the working face. Drilling mud may pressurize the fluid passageway, causing the first axial force. The opposing force may be generated by contacting the indenting end of the jack element against a subterranean formation. The restriction causes the pressure in the fluid passageway to build up until it overcomes the opposing force and displaces the jack element in the direction of the first axial force, opening the restriction and thereby relieving the pressure in the fluid passageway. The jack element may be displaced 0.010 to 0.100 inches. After relieving the pressure in the passageway, the opposing force overcomes the first axial force and substantially returns the jack element to its original position. This reestablishes the restriction in which the first axial force is reformed by pressurizing the fluid passageway. The building up and relieving of the pressure causes the jack element to oscillate. As a result, the drill bit is able to percussively fail a formation in a fluid environment.

In one embodiment of a method, the restriction may restrict all flow within the fluid passage. In other embodiments, the restriction may restrict a portion of the flow within the fluid passage. The jack element may be rotated by a motor or turbine. The jack element may also be rotationally isolated from the fluid passageway of the drill bit. A non-contact seal, such as a labyrinth seal, may be disposed in the fluid passageway to inhibit fluid passage. The jack element may also be laterally supported by a bearing that comprises a material with a hardness of at least 58 HRc. A spring coaxial with the jack element and proximal the drill bit may be positioned within the fluid passageway so as to engage the jack element.

DETAILED DESCRIPTION OF THE INVENTION AND THE PREFERRED EMBODIMENT

Figure 1:
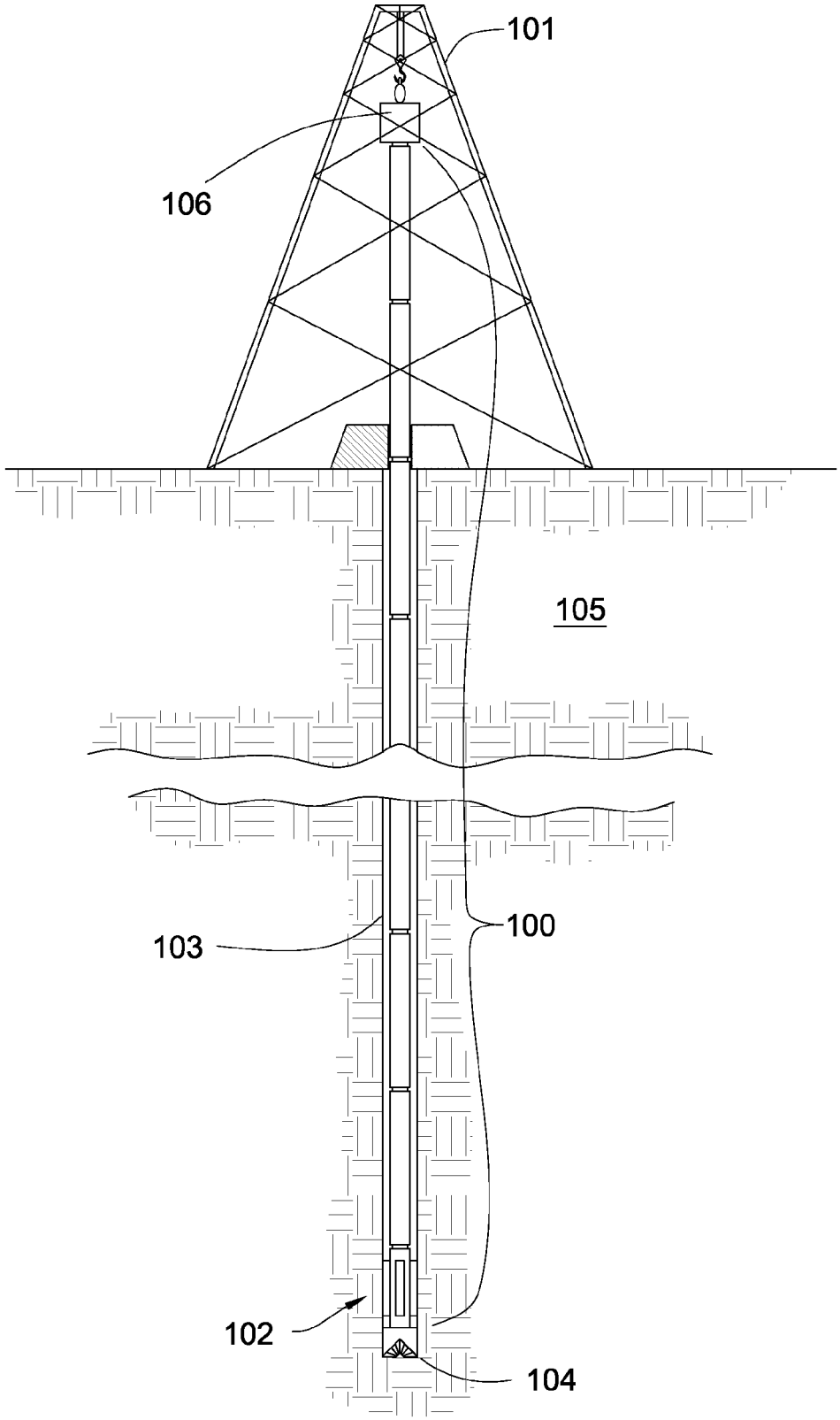
FIG. 1 is a perspective diagram of an embodiment of a drill string suspended in a bore hole.

FIG. 1 is a cross-sectional diagram of an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string 100 may penetrate soft or hard subterranean formations 105. The bottom hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
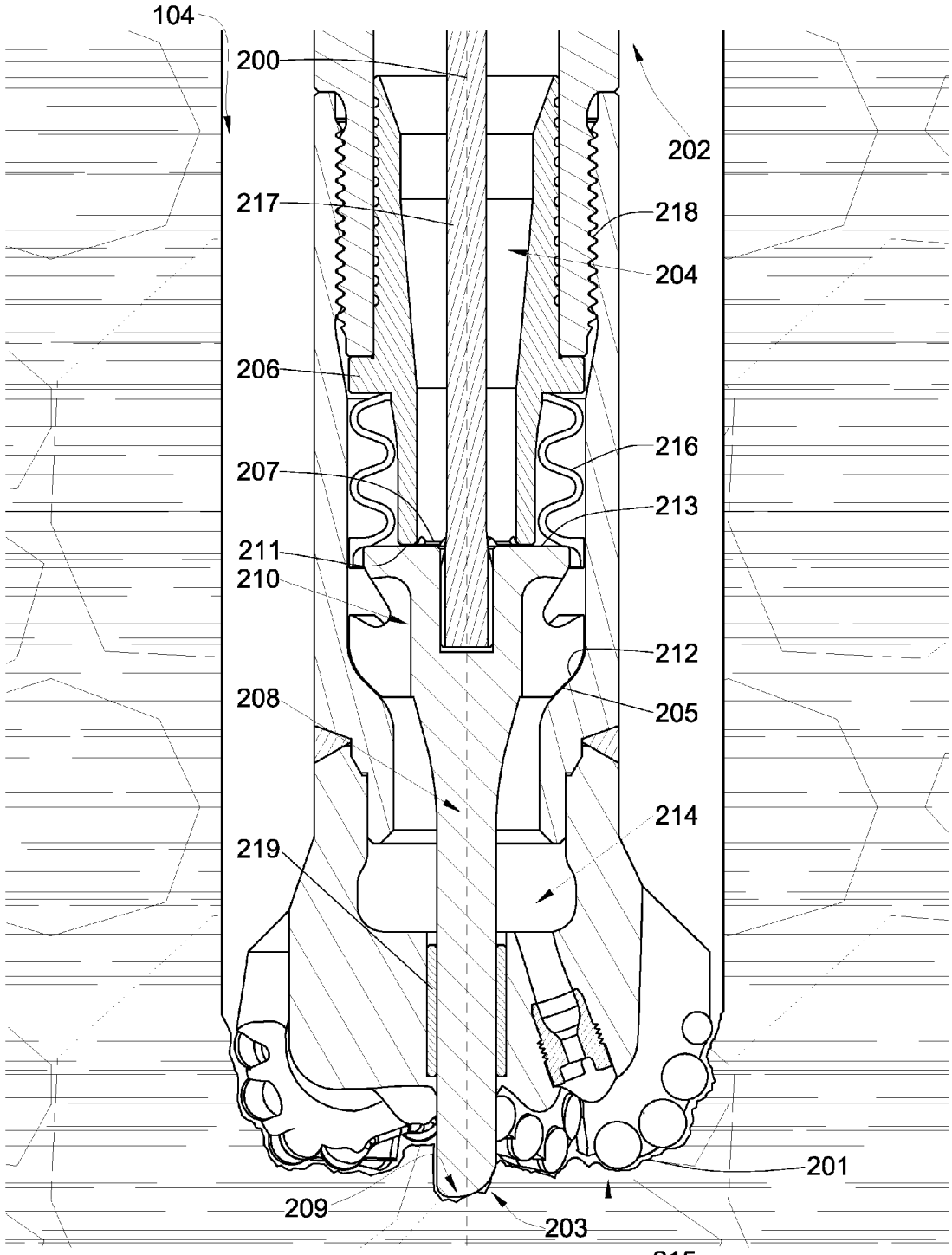
FIG. 2 is a cross-sectional diagram of an embodiment of a drill bit.

FIG. 2 is a cross-sectional diagram of a preferred embodiment of a drill bit 104. The drill bit 104 comprises an axis of rotation 200, a working face 201, a threaded end 202, and a jack element 203. In this embodiment, a fluid passageway 204 has a first seat 205 and houses the jack element 203. A stop element 206 disposed within the passageway 204 has a first near-sealing surface 207. In this embodiment, the jack element 203 is generally coaxial with the axis of rotation 200 and comprises a shaft 208 intermediate an indenting end 209 extending from the working face 201 and a valve portion 210. The jack element 203 also comprises a second near-sealing surface 211 in fluid communication with the fluid passageway 204 of the drill bit 104. The second near-sealing surface 211 may be adjacent to the first near-sealing surface 207. A second seat 212 formed in the jack element 203 may be adjacent the first seat 205.

A portion of the jack element 203 forms an adjustable restriction 213 in a fluid passage intermediate the fluid passageway 204 and an opening 214 disposed in the working face 201. The adjustable restriction 213 is adapted to move to relieve pressure build up in the passageway when a fluid is passed through the fluid passageway 204. When a fluid is passed through the fluid passageway 204, the jack element 203 is pushed against the formation which resists the jack element axially loading it in a direction depicted by arrow 215. The first and second near-sealing surfaces may contact each other, restricting fluid passage and therefore causing a pressure to build up in the fluid passageway 204. The pressure build up produces a first axial force. An opposing force may also be applied in the opposite direction. This force may be generated by contacting the indenting end 209 against a subterranean formation 105. If the first axial force overcomes the opposing force, the jack element 203 may displace in the direction of the first axial force in which the first seat 205 may contact the second seat 212. The opposing force may then overcome the first axial force causing the jack element 203 to substantially return to its original position, reforming the restriction. The continual displacing of the jack element 203 and reforming of the restriction 213 may produce an oscillation. The oscillation may provide the drill bit with some of the advantages found in a typically percussion bit, which may increase the bit's rate of penetration.

When drilling in soft formations, the first axial force may be greater than the opposing force wherein the jack element 203 may not necessarily oscillate, but rather the valve portion 210 will approximate the respective seats. However, when drilling in hard formations, the jack element 203 may oscillate since the formation will be able to substantially return the jack element to its original position. In some embodiments, the restriction 213 may inhibit all fluid passage, and in other embodiments, the restriction 213 may always allow fluid passage. If the restriction 213 inhibits all fluid passage, the pressure will build up in the fluid passageway 204 at a rate greater than if the restriction 213 allows some fluid passage.

The drill bit 104 may comprise a spring 216 coaxial with the jack element 203 and proximal the drill bit 104. The spring 216 may be positioned within the fluid passageway 204 adapted to engage the jack element 203. The spring 216 may be a coil spring, a Belleville spring, a compression spring, a tension spring, or a gas spring. In some embodiments the spring may be the stop element.

The second near-sealing surface 211 may have a rounded or flat geometry and may have a hardness of at least 58 HRc. The surface 211 may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and combinations thereof. The restriction 213 also comprises a surface with a hardness of at least 58 HRc.

The drill bit 104 may also comprise an axle 217 generally coaxial with the axis of rotation 200. The axle 217 may be rotated by a motor or turbine. The an end of the axle 217 which may interlock with the jack element 203 may be generally cylindrically shaped, generally rectangular, or generally polygonal. In some embodiments, the jack element 203 is rotationally isolated from the fluid passageway 204 of the drill bit 104 and the axle 217 may rotate the jack element 203.

Preferably, the indenting end 209 comprises a superhard material and an asymmetric geometry. During a drilling operation, the rotational velocity of the jack element 203 may be adjusted so that the indenting end 209 may steer the drill bit 104 in a desired direction. Thus in drilling applications where a changed direction is preferred, the jack element 203 may not rotate and thereby the indenting end 209 may guide the drill bit 104 in the preferred direction. Further, when the current direction is preferred, the jack element 203 will rotate at a given velocity so that the indenting end 203 may guide the drill bit 104 in the current direction.

A non-contact seal 218 may be disposed in the fluid passageway 204 of the drill bit 104 to inhibit fluid passage. The non-contact seal 218 may allow some fluid passage or may restrict all fluid passage. The non-contact seal 218 may generally be a labyrinth seal. A portion of the jack element 203 may be laterally supported by a bearing 219. The bearing 219 comprises a material with a hardness of at least 58 HRc. The bearing 219 may support the jack element 203 when it is subjected to lateral loads.

Figure 4:
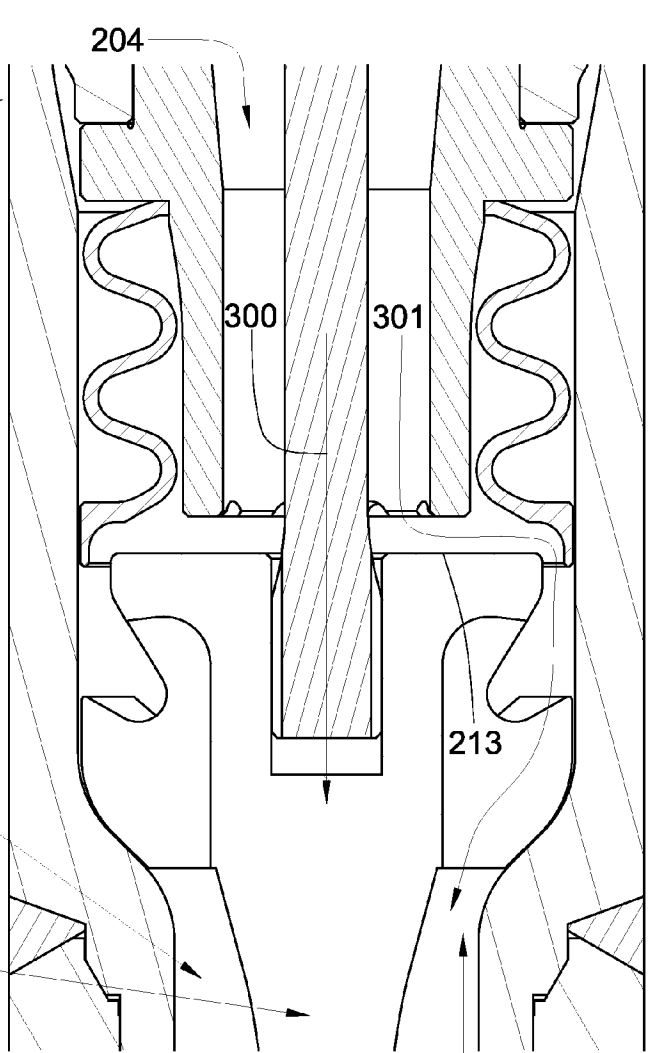
FIG. 4 is a cross-sectional diagram of another embodiment of an adjustable restriction.
Figure 3:
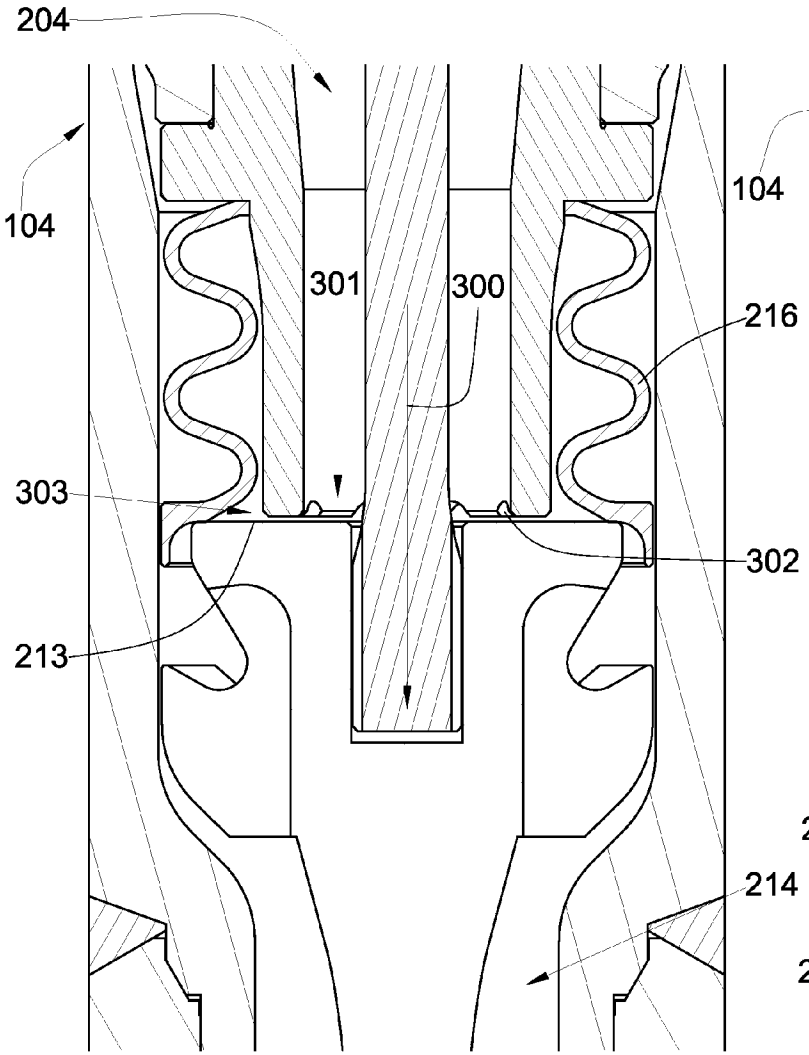
FIG. 3 is a cross-sectional diagram of an embodiment of an adjustable restriction.

FIGS. 3 and 4 are cross-sectional diagrams of an embodiment of an adjustable restriction 213. During a drilling operation, a first axial force, indicated by arrow 300, may be applied by pressurizing the fluid passageway 204 of the drill bit 104. The fluid passageway 204 may be pressurized generally by drilling mud, generally by air or generally by water. In this embodiment, the restriction 213 restricts a portion of a fluid flow indicated by arrow 301 within the fluid passage. One or more fluid ports 302 may allow fluid to pass through the fluid passageway 204 into a space 303 adjacent the spring 216. During a drilling operation as shown in FIG. 4 an opposing force, indicated by arrow 400 may be applied to the jack element 203. The restriction 213 causes the pressure in the fluid passageway 204 to build up until it overcomes the opposing force 400 and displaces the jack element 203 in the direction of the first axial force 300, opening the restriction 213 and thereby relieving the pressure in the fluid passageway 204 by allowing the fluid flow 301 to pass by the restriction 213 into the opening 214. The jack element 203 may be displaced 0.010 to 0.100 inches when relieving the pressure in the fluid passageway 204. After relieving the pressure in the fluid passageway 204, the opposing force 400 overcomes the first axial force 300 and generally returns the jack element 203 to its original position and reestablishes the restriction 213.

Figure 5:
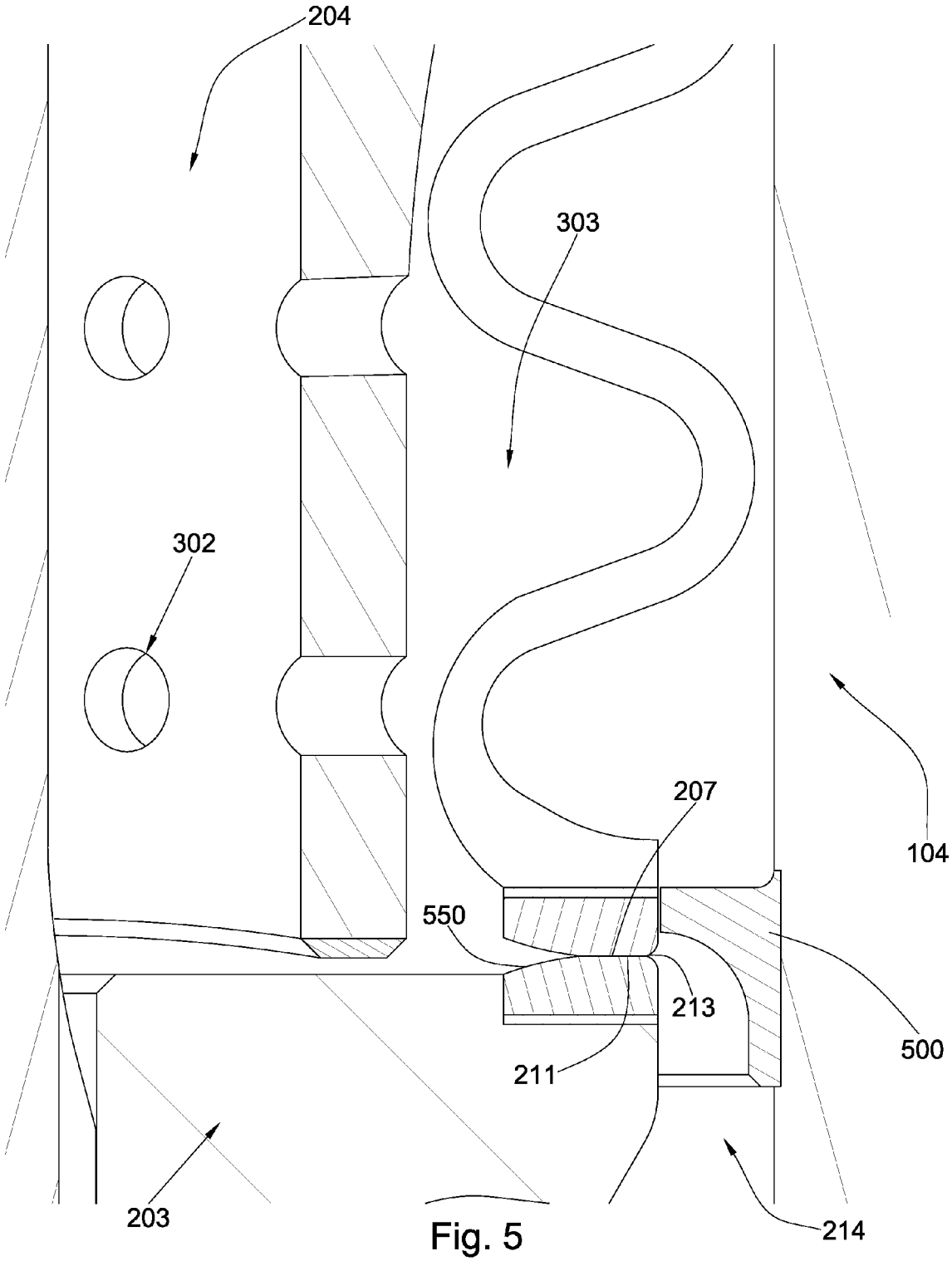
FIG. 5 is a cross-sectional diagram of another embodiment of a drill bit.

FIG. 5 is a cross-sectional diagram of another embodiment of a drill bit 104. This embodiment is a close up of a portion of a restriction 213 that inhibits fluid passage when closed. During a drilling operation, fluid passes through the fluid passageway 204. Fluid may pass through one or more fluid ports 302 into an opening 214. A first near-sealing surface 207 and a second near-sealing surface 211 may be in contact, restricting fluid passage into an opening 214. However, as fluid is forced into the fluid passageway 204, pressure builds up and eventually causes the first and second near-sealing surfaces to separate, displacing the jack element 203. Fluid within the fluid passageway 204 and within the space 303 adjacent the spring 216 will pass through the separated surfaces, directed by an insert element 500, until the pressure is substantially relieved, wherein the jack element 203 will be restored to its original position and the first and second near-sealing surfaces will be in contact again. The insert element may be made of a material with a hardness of at least 58 HRc to prevent its erosion from pressurized fluid passage. In the embodiment of FIG. 5, the near sealing surfaces are made of a super hard material such as silicon carbide, diamond, or cubic boron nitride. In some embodiments, a cemented metal carbide may also be used. The superhard material may be formed in segments with a high temperature high pressure press and then ground to a preferred geometry. In some embodiments the use of an electric discharge machine may be used to further shape the super hard material. A chamfer 550 on the side of the superhard material which experiences the highest pressure may be used to reduce wear. The super hard material may be brazed or pressure fit into the jack element or the spring.

Figure 6:
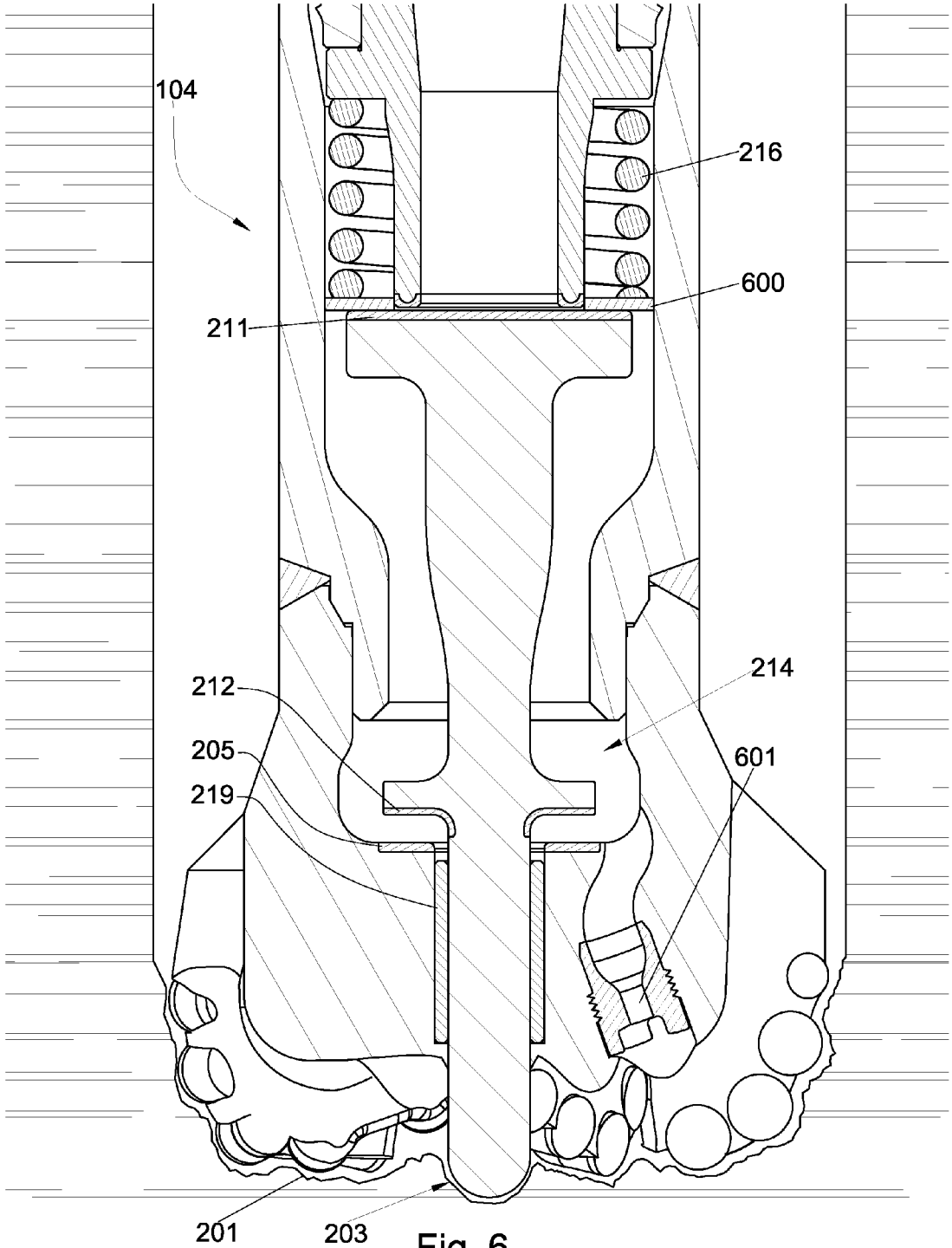
FIG. 6 is a cross-sectional diagram of another embodiment of a drill bit.

FIG. 6 is a cross-sectional diagram of another embodiment of a drill bit 104. This embodiment may contain a coiled spring 216 that engages the jack element 203. The second near-sealing surface 211 may comprise a washer 600 with a surface of at least 58 HRc that inhibits fluid communication with the spring 216. The second near-sealing surface 211 of the jack element 203 may have a hardness of at least 58 HRc. A first near-sealing surface 207 may contact the second near-sealing surface 211 of the jack element 203. The first near-sealing surface 207 may comprise a material of at least 58 HRc. The jack element 203 may also have a second seat 212 that may contact a first seat 205 to limit the displacement of the jack element 203. The first seat 205 and the second seat 212 may comprise a material of at least 58 HRc. The jack element 203 may be laterally supported by a bearing 219 comprising a material of at least 58 HRc. The drill bit 104 may also contain a nozzle 601 disposed within the opening 214 to control the fluid flow that may exit the working face 201 of the drill bit 104.

Figure 7:
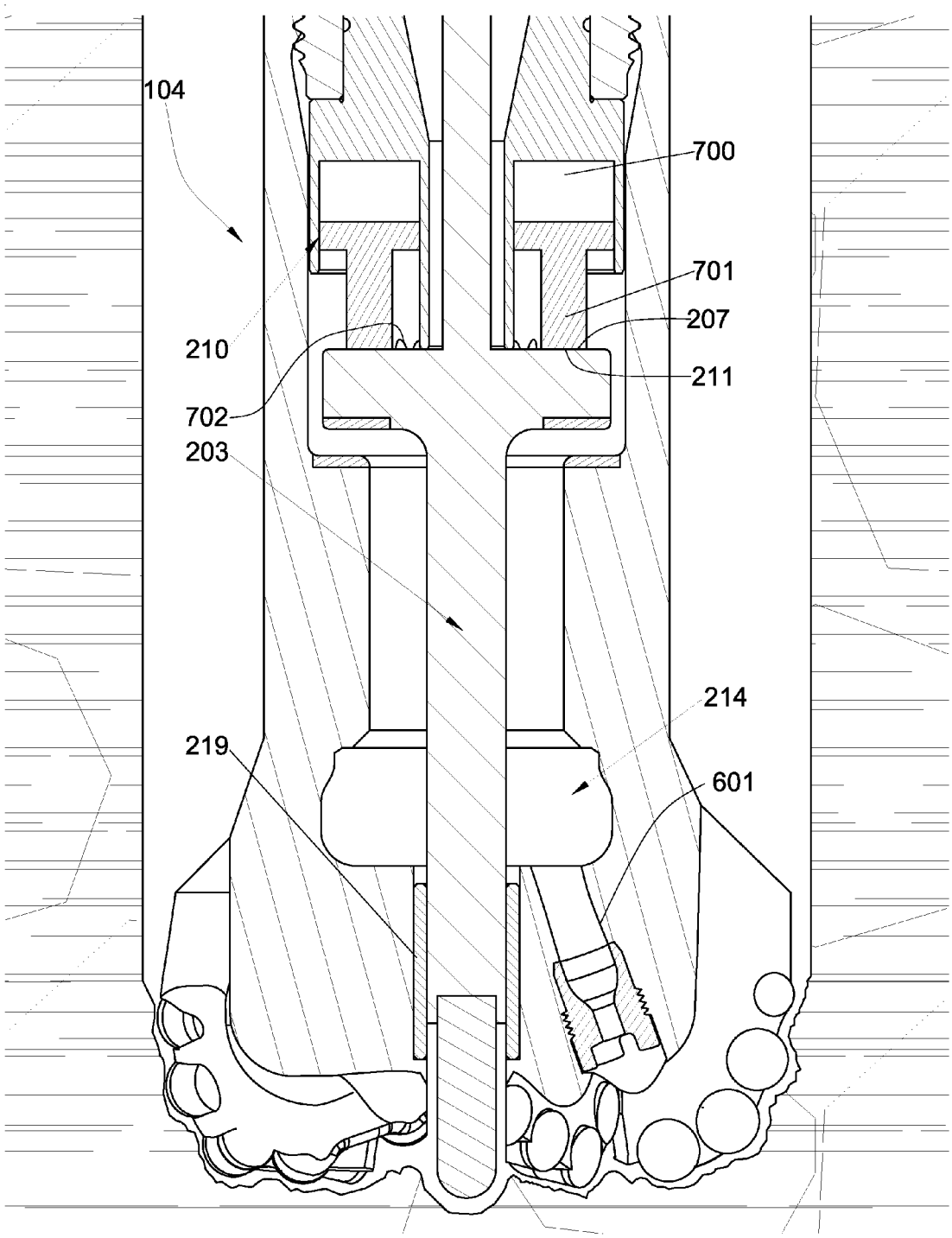
FIG. 7 is a cross-sectional diagram of another embodiment of a drill bit.

FIG. 7 is a cross-sectional diagram of another embodiment of a drill bit 104. This embodiment may contain at least one gas spring 216 that responds to the displacement of the jack element 203. The gas spring 216 is activated by compressing a gas, preferably nitrogen, in a gas compartment 700 with a piston 701. The gas spring 216 may allow fluid passage through a least one fluid port 702. Another variation of the gas spring 216 may allow fluid passage through channels intermediate the gas compartment 700 and the second near-sealing surface 211 of the jack element 203. The second near-sealing surface 211 and the first near-sealing surface 207 may comprise materials of at least 58 HRc. In this embodiment the drill bit 104 may contain a nozzle 601 disposed within the opening 214. The jack element 203 may be laterally supported by a bearing 219 comprising a material of at least 58 HRc.

Figure 9:
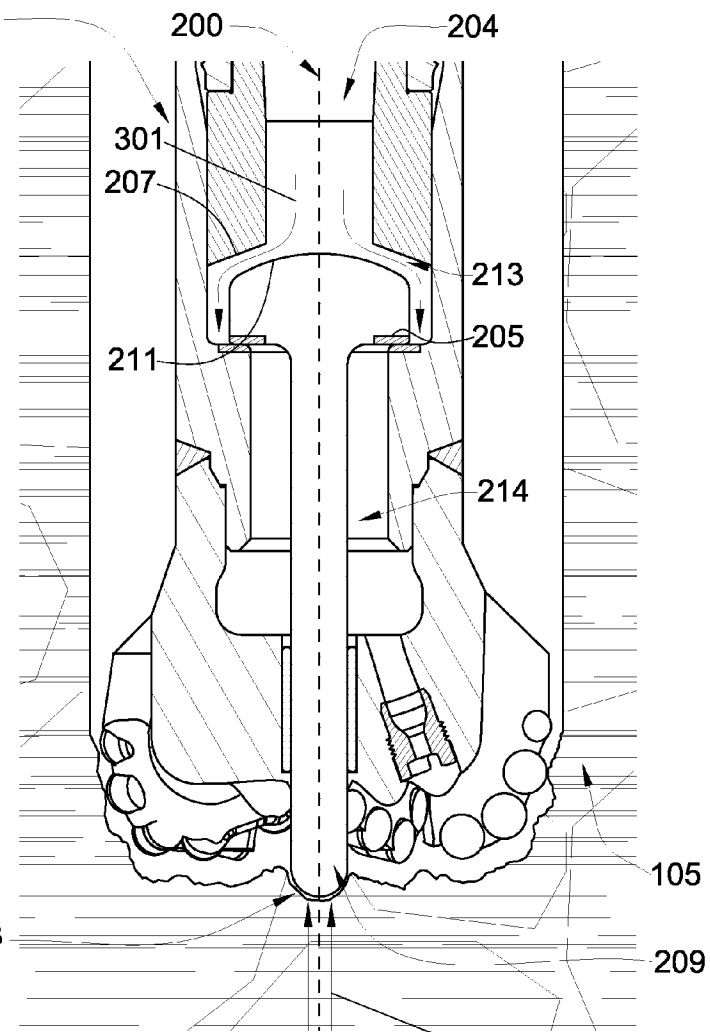
FIG. 9 is a cross-sectional diagram of another embodiment of an adjustable restriction.
Figure 8:
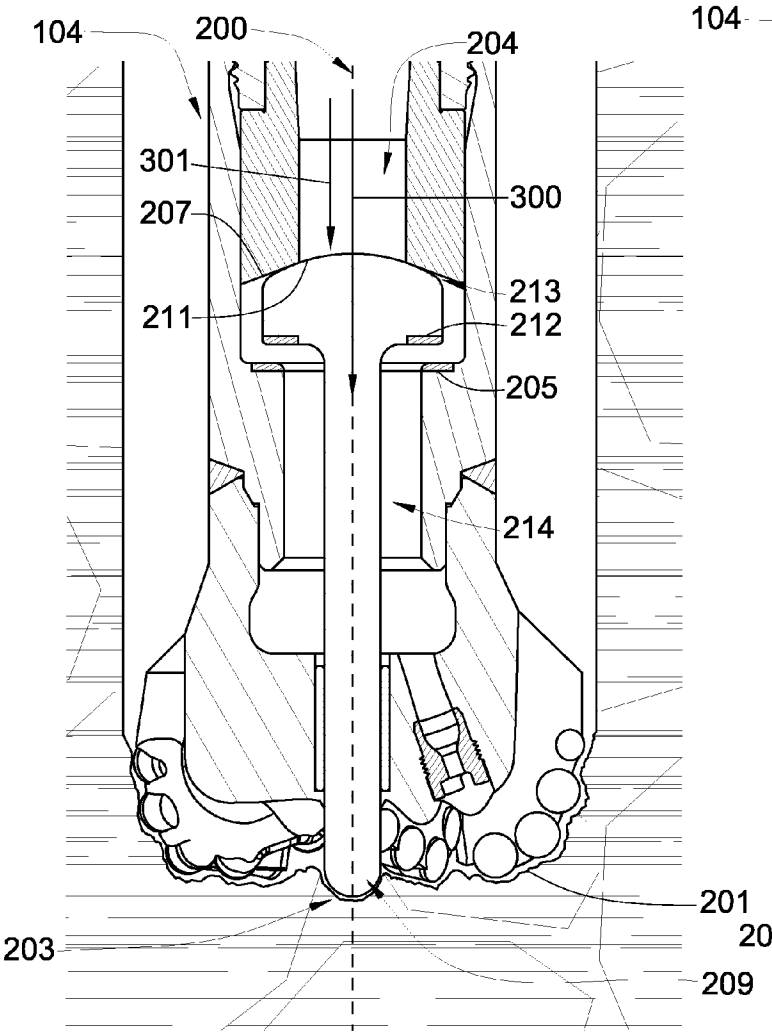
FIG. 8 is a cross-sectional diagram of another embodiment of an adjustable restriction.

FIGS. 8 and 9 are cross-sectional diagrams of another embodiment of an adjustable restriction 213. This embodiment comprises a jack element 203 substantially coaxial with the axis of rotation 200 and comprising an indenting end 209 extending from the working face 201. The second near-sealing surface 211 is in fluid communication with the fluid passageway 204 of the drill bit 104. The second near-sealing surface 211 may also comprise a rounded geometry. A portion of the jack element 203 forms a restriction 213 in a fluid passage from the fluid passageway 204 to at least one opening 214 disposed in the working face 201. As shown in FIG. 8, the restriction 213 is formed intermediate the first near-sealing surface 207 and the second near-sealing surface 211 and restricts all fluid flow 301 within the fluid passage. A first axial force 300 may be applied by pressurizing the fluid passageway 204 of the drill bit 104 with drilling fluid. The restriction causes pressure in the fluid passageway to build up. The accumulated pressure causes the jack element 203 to displace in the direction of the first axial force 300, opening the restriction 213 and thereby relieving the pressure in the fluid passageway 204. As indicated in FIG. 9, an opposing force 400 may be applied to the jack element 203, which may be generated by contacting the indenting end 209 of the jack element 203 against a subterranean formation 105. A second seat 212 may contact a first seat 205, restricting fluid flow 301 to the opening 214. The opposing force 400 may overcome the first axial force and substantially return the jack element 203 to its original position and reform the restriction 213.

Figure 10:
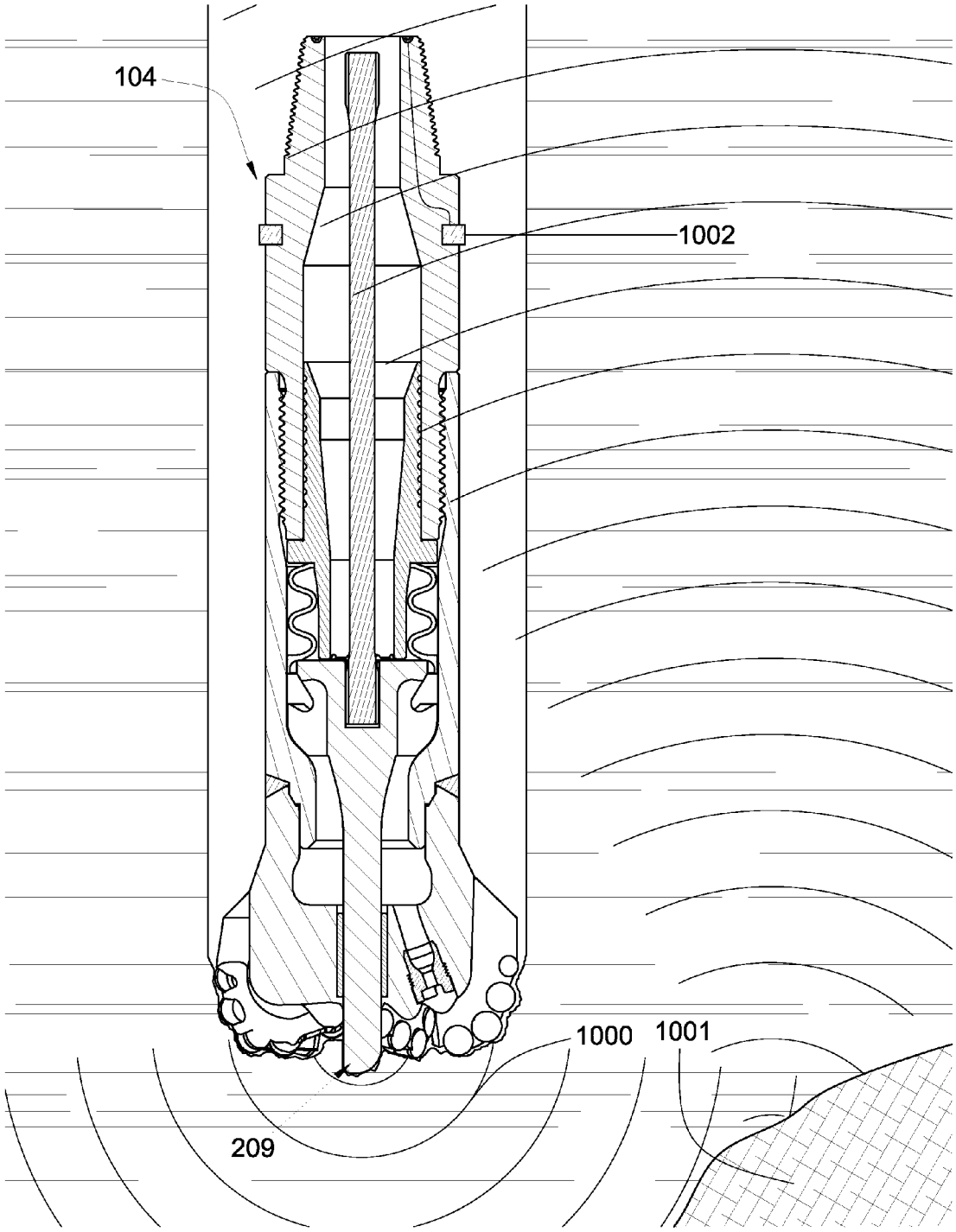
FIG. 10 is a cross-sectional diagram of an embodiment of a drill bit showing paths of energy emitted at the indenting end.

FIG. 10 is a cross-sectional diagram of an embodiment of a drill bit 104 showing paths of energy emitted at the indenting end 209 as it oscillates. In this embodiment, acoustic waves 1000 may be emitted from the indenting end 209 and may reach an acoustic impedance boundary 1001. Acoustic impedance boundaries 1001 may be a result from a feature in the subterranean formation 105 such as a fault, a salt body, change in formation hardness, change in formation material, a hydrocarbon formation, a change in density or other changes in the formation. Acoustic waves 1000 reflect off of such acoustic impedance boundaries 1001 and may be sensed by energy receivers 1002 in the drill bit 104. The receivers may be geophones, hydrophones or other seismic sensors. Physical attributes of acoustic boundaries 1001 such as its spatial location and dimensional or surface attributes, acoustic properties and composition may be realized by interpreting the waves received by the energy receivers 1002. These attributes may then be used to direct the drill bit 104 along an economic trajectory with respect to the acoustic boundaries 1001.

Sensors 1002 may be located in the drill bit itself, at some location along the tool string or at the surface. In some embodiments, the sensors may be located in a tool string component attached to the drill bit 104. Other sensors (not shown) may be used to record the frequency of the jack element's oscillations and as well as time stamp at least some of jack element's impacts into the formation. This information may be correlated with the time and frequency of acoustic reflections received, which may help identify the distance from the bit and type of acoustic boundary that is encountered. Also the used inclination and direction package may help determine the location of the acoustic impedance boundary.

Figure 11:
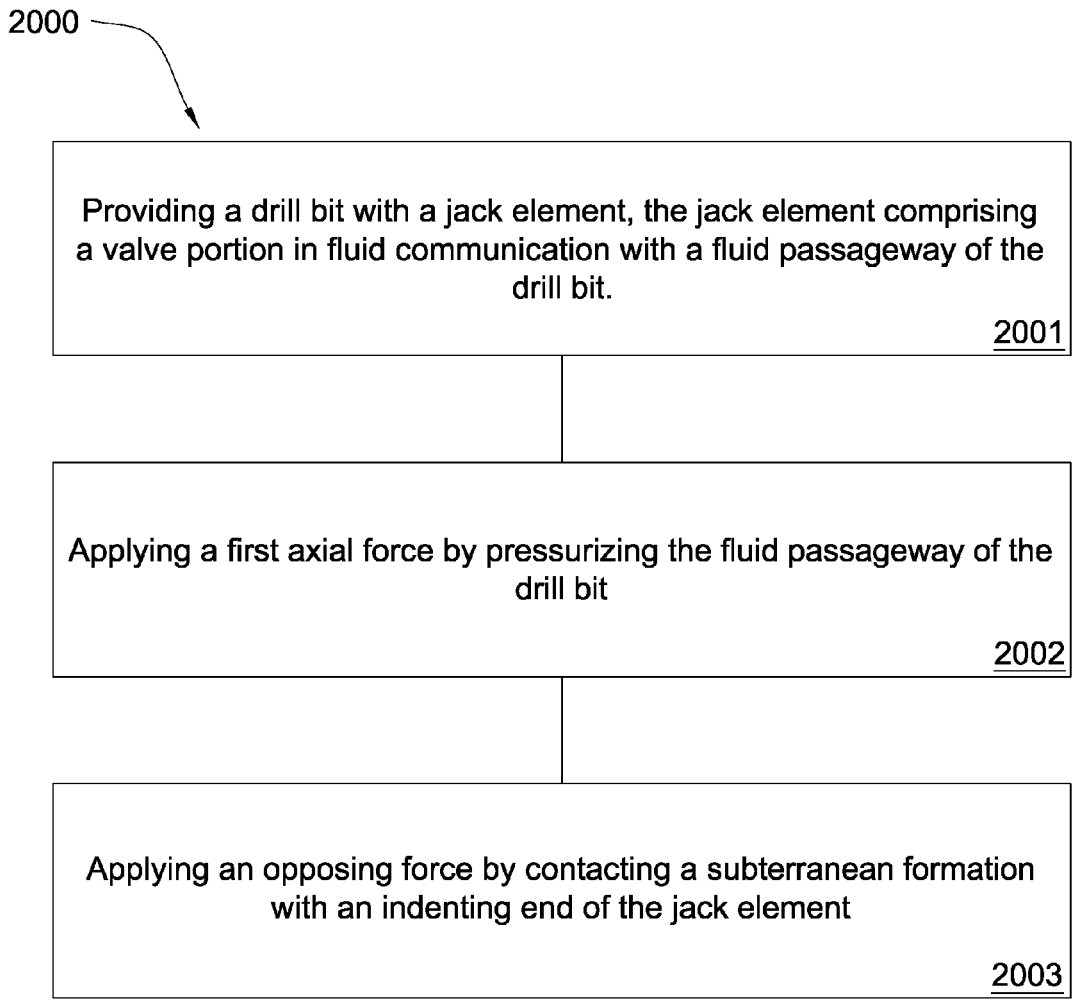
FIG. 11 is a diagram of an embodiment of a method for drilling a well bore.

FIG. 11 is a diagram of an embodiment of a method 2000 for drilling a well bore. The method 2000 includes providing 2001 a drill bit with a jack element that comprises a valve portion in fluid communication with a fluid passageway of the drill bit. A portion of the jack element forms a restriction so that fluid may not pass from the fluid passageway to an opening disposed in a working face. The method also includes applying 2002 a first axial force by pressurizing the fluid passageway of the drill bit. The first axial force may be generated by pressure build up in the fluid passageway from the restriction of fluid passage. Further the method 2000 includes applying 2003 an opposing force by contacting a subterranean formation with an indenting end of the jack element. The jack element may be displaced in the direction of the first axial force and then returned to its original position, causing the jack element to oscillate.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

an axis of rotation and a drill bit body intermediate a threaded end and a working face;

the drill bit body comprising a fluid passageway comprising a first seat and housing a jack element substantially coaxial with the axis of rotation;

a stop element disposed within the passageway comprising a first near-sealing surface;

the jack element comprising a shaft intermediate an indenting end and a valve portion, the indenting end extending through the working face;

the valve portion comprising a second near-sealing surface disposed adjacent the first near-sealing surface and a second seat disposed adjacent the first seat;

wherein as the formation being drilled strongly resists the jack element, the distance between the respective sealing surfaces narrows causing an increase in fluid pressure within the passageway and forcing the indenting end down into formation, which movement of the jack relieves the pressure build such that the formation pushes the jack element back thereby oscillating the jack element.

2. The drill bit of claim 1, wherein when the formation being drilled lightly resists the jack element the valve portion approximates the respective seats.

3. The drill bit of claim 1, wherein the second near-sealing surface has a rounded geometry.

4. The method of claim 1, wherein a nozzle is disposed within an opening in the working face.

5. The drill bit of claim 1, wherein the second near-sealing has a surface with a hardness of at least 58 HRc.

6. The drill bit of claim 1, wherein the first near-sealing has a surface with a hardness of at least 58 HRc.

7. The drill bit of claim 1, wherein the near-sealing surfaces comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TIAlN, ZrN, diamond impregnated carbide, diamond impregnated matrix, silicon bounded diamond, and combinations thereof.

8. The drill bit of claim 1, wherein the indenting end comprises a superhard material.

9. The drill bit of claim 1, wherein the indenting end comprises an asymmetric geometry.

10. The drill bit of claim 1, wherein the jack element is rotationally isolated from the fluid passageway of the drill bit.

11. The drill bit of claim 1, wherein a non-contact seal disposed in the fluid passageway is formed to inhibit fluid passage.

12. The drill bit of claim 1, wherein the drill bit is attached to a downhole tool string, wherein the downhole tool string comprises a sensor adapted to receive acoustic reflections produced by the movement of the jack element.

13. The drill bit of claim 1, wherein at least a portion of the jack element is laterally supported by a bearing.

14. The drill bit of claim 1, wherein the bearing comprises a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and combinations thereof.

15. The drill bit of claim 1, wherein a spring coaxial with the jack element proximal the drill bit is positioned within the fluid passageway and adapted to contact the jack element.

16. A method for drilling a well bore, comprising the steps of:

providing a drill bit with an axis of rotation and a drill bit body intermediate a threaded end and a working face;

the drill bit body comprising a fluid passageway housing a jack element;

a stop element disposed within the passageway comprising a first near-sealing surface;

the jack element comprising a valve portion and an indenting end extending through the working face;

the valve portion comprising a second near-sealing surface disposed adjacent the first near-sealing surface;

applying a first axial force by pressurizing the fluid passageway of the drill bit; and applying an opposing force to the jack element.

wherein the first near-sealing surface and the second near-sealing surface form a restriction in a fluid passage from the fluid passageway to at least one opening disposed in the working face;

wherein the restriction causes the pressure in the fluid passageway to build up until it overcomes the opposing force and displaces the jack element in the direction of the first axial force, opening the restriction and thereby relieving the pressure in the fluid passageway, wherein after relieving the pressure in the fluid passageway, the opposing force overcomes the first axial force and substantially returns the jack element to its original position and reforms the restriction.

17. The method of claim 16, wherein the jack element is rotated by a motor or a turbine.

18. The method of claim 16, wherein the restriction restricts all flow within the fluid passage.

19. The method of claim 16, wherein the restriction restricts a portion of the flow within the fluid passage.

20. The method of claim 16, wherein the opposing force is generated by contacting the indenting end of the jack element against a subterranean formation.

* * * * *